US011241099B2

(12) United States Patent
Walker et al.

(10) Patent No.: US 11,241,099 B2
(45) Date of Patent: Feb. 8, 2022

(54) CUP HOLDER FOR ATTACHMENT AT BACK OF AUDITORIUM/THEATER SEATING

(71) Applicant: Irwin Seating Company, Grand Rapids, MI (US)

(72) Inventors: Heather Walker, Comstock Park, MI (US); John P. Conner, Grandville, MI (US)

(73) Assignee: IRWIN SEATING COMPANY, Grand Rapids, MI (US)

( * ) Notice: Subject to any disclaimer, the term of this patent is extended or adjusted under 35 U.S.C. 154(b) by 38 days.

(21) Appl. No.: 16/820,774

(22) Filed: Mar. 17, 2020

(65) Prior Publication Data

US 2020/0297116 A1 Sep. 24, 2020

Related U.S. Application Data

(60) Provisional application No. 62/819,736, filed on Mar. 18, 2019.

(51) Int. Cl.
*A47C 7/62* (2006.01)
*A47C 1/12* (2006.01)

(52) U.S. Cl.
CPC ..... *A47C 7/622* (2018.08); *A47C 1/12* (2013.01)

(58) Field of Classification Search
CPC ..... A47C 7/622; A47C 1/12
USPC ..... 297/188.2
See application file for complete search history.

(56) References Cited

U.S. PATENT DOCUMENTS

| | | | | | |
|---|---|---|---|---|---|
| 2,995,333 | A | * | 8/1961 | Pazzano | A47C 7/62 248/230.7 |
| 4,795,211 | A | | 1/1989 | Stern et al. | |
| 5,302,000 | A | | 4/1994 | Ayotte | |
| 5,356,107 | A | * | 10/1994 | Sinohuiz | A47C 7/62 248/311.2 |
| 5,421,638 | A | | 6/1995 | Ayotte et al. | |
| 5,597,148 | A | * | 1/1997 | Gospodarich | 248/311.2 |
| 5,628,103 | A | | 5/1997 | Ayotte et al. | |
| 5,695,162 | A | * | 12/1997 | DiCastro | A47C 7/622 248/231.81 |
| 5,709,429 | A | | 1/1998 | Bergin | |
| 5,813,644 | A | | 9/1998 | Bergin | |
| 5,938,091 | A | | 8/1999 | Bergin et al. | |
| 6,109,580 | A | | 8/2000 | Stern et al. | |
| 6,186,382 | B1 | | 2/2001 | Bergin et al. | |
| 6,231,058 | B1 | | 5/2001 | Kimbrough et al. | |
| 6,283,551 | B1 | | 9/2001 | Bergin | |

(Continued)

*Primary Examiner* — Anthony D Barfield
(74) *Attorney, Agent, or Firm* — Honigman LLP

(57) ABSTRACT

A cup holder for a seat of an auditorium or theater includes a cup receiving body and a mounting arm. The cup receiving body is configured to receive and support a cup therein. The mounting arm extends from the cup receiving body and includes a receiving portion and an attachment portion. With the mounting arm extending across a side portion of a seat back frame of a single seat, and with the receiving portion receiving a front portion of the seat back frame and the mounting arm extending from the front portion of the seat back frame to a rear portion of the seat back frame, the attachment portion of the mounting arm abuts the rear portion of the seat back frame, and the attachment portion is attached at the seat back frame to secure the cup holder relative to the seat back frame.

20 Claims, 5 Drawing Sheets

(56) References Cited

U.S. PATENT DOCUMENTS

| | | | | |
|---|---|---|---|---|
| 6,457,772 | B1 * | 10/2002 | Forston | A47C 7/62<br>297/188.04 |
| 6,641,101 | B2 | 11/2003 | Bergin | |
| 6,652,030 | B2 | 11/2003 | Conner et al. | |
| 6,976,735 | B1 | 12/2005 | Bergin | |
| RE39,392 | E | 11/2006 | Bergin | |
| 7,198,327 | B2 | 4/2007 | Bergin | |
| 7,614,703 | B2 | 11/2009 | Bergin | |
| 8,256,835 | B2 | 9/2012 | Brink et al. | |

* cited by examiner

CUP HOLDER FOR ATTACHMENT AT BACK OF AUDITORIUM/THEATER SEATING

CROSS REFERENCE TO RELATED APPLICATION

The present application claims the filing benefits of U.S. provisional application Ser. No. 62/819,736, filed Mar. 18, 2019, which is hereby incorporated herein by reference in its entirety.

FIELD OF THE INVENTION

The present invention relates generally to a chair or seat for stadium or theater or auditorium seating and, more particularly, to a cup holder for mounting at a chair or seat.

BACKGROUND OF THE INVENTION

It is known to provide a cup holder at a theater or auditorium or stadium type chair or seat. Typically, a cup holder is installed at the arm rest between two chairs for use by a person sitting at one of those two chairs. Often, a cup holder is installed at the rear of the seating structure for use by a person sitting in a chair behind where the cup holder is installed. Such rear-mounted cup holders mount to the back of two adjacent seats so as to be positioned at the gap between the seat backs. The bracket of the cup holder is typically fastened via screws at each of the seat backs and often differences in the gap size between different seats gives rise to difficulties in mounting the cup holders.

SUMMARY OF THE INVENTION

The present invention provides a cup holder that mounts at a seat back of a single seat of a row of seats arranged at an auditorium or theater or stadium, such that the cup holder is usable by a person sitting in a seat behind the seat at which the cup holder is installed. The cup holder comprises a mounting arm that comprises (i) a receiving portion that receives or hooks around a front part of the seat back frame of the seat and (ii) a fastening portion that abuts a rear surface of the seat back frame for fastening or securing the cup holder at the desired height, such as via one or more fasteners. Thus, the cup holder may be readily positioned at a seat back and moved or slid along the seat back frame (via sliding movement of the receiving portion along the front part of the seat back frame that is received in the receiving portion) to a desired height, whereby one or more fasteners may be used to secure the fastening portion (and the cup holder) at the desired location at the seat back. The cup holder is mounted only to a single seat back, and thus avoids difficulties that may otherwise arise due to variations in the gap between adjacent seat backs of seats arranged in a row at an auditorium or theater or stadium or the like.

These and other objects, advantages, purposes and features of the present invention will become apparent upon review of the following specification in conjunction with the drawings.

DESCRIPTION OF THE PREFERRED EMBODIMENTS

Figure 1:
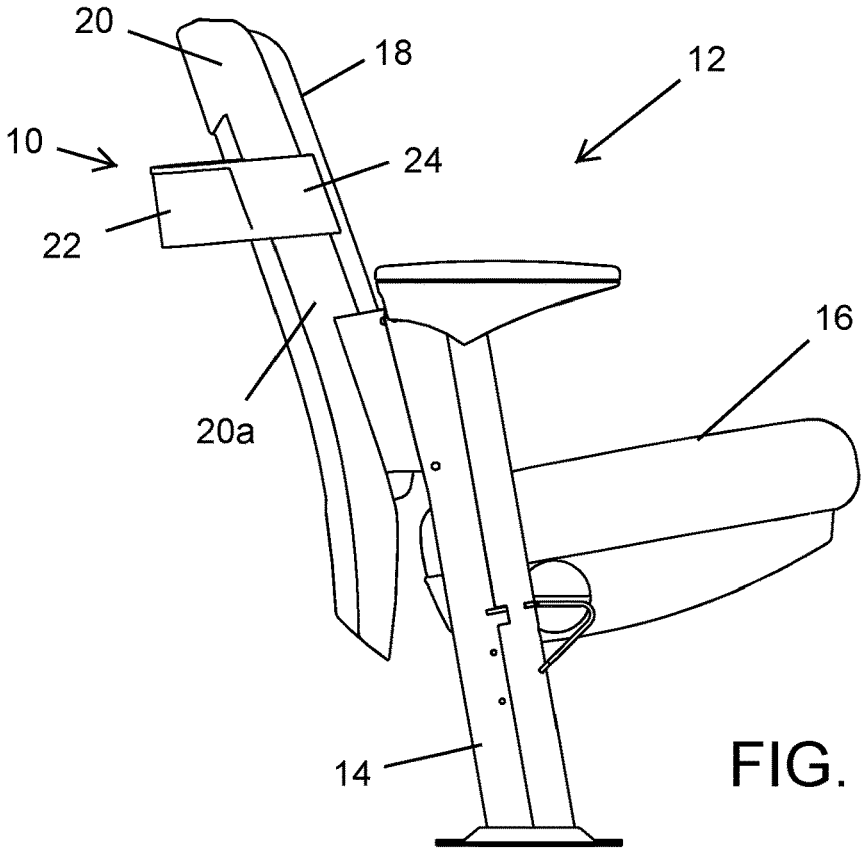
FIG. 1 is a side elevation of a seat having a cup holder positioned at the seat back in accordance with the present invention.
Figure 2:
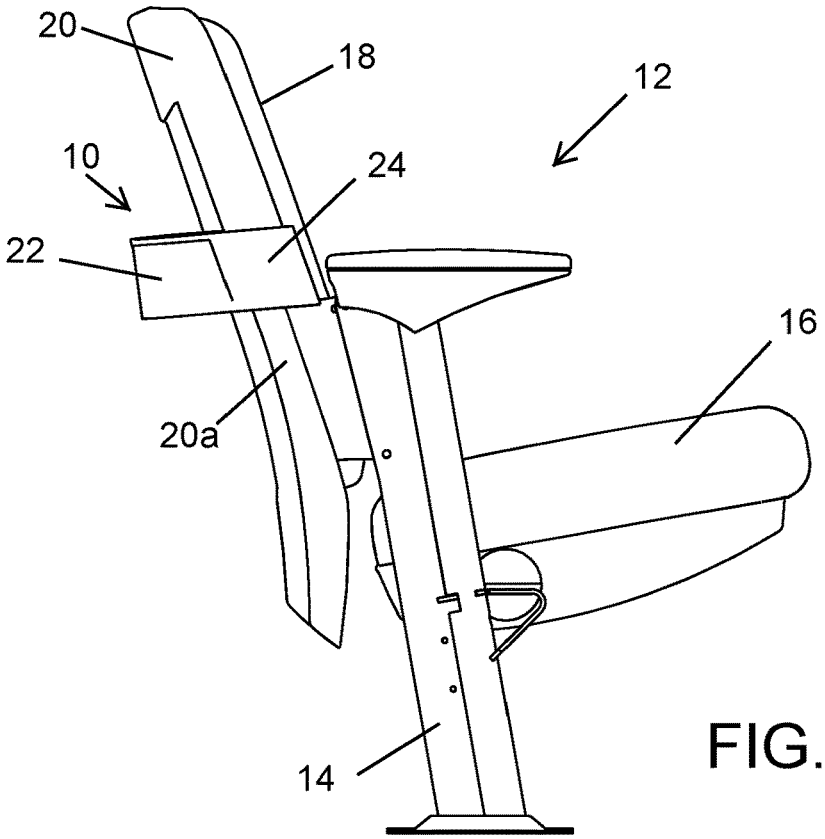
FIG. 2 is another side elevation of the seat and cup holder, shown with the cup holder at a lowered position along the seat back.
Figure 3:
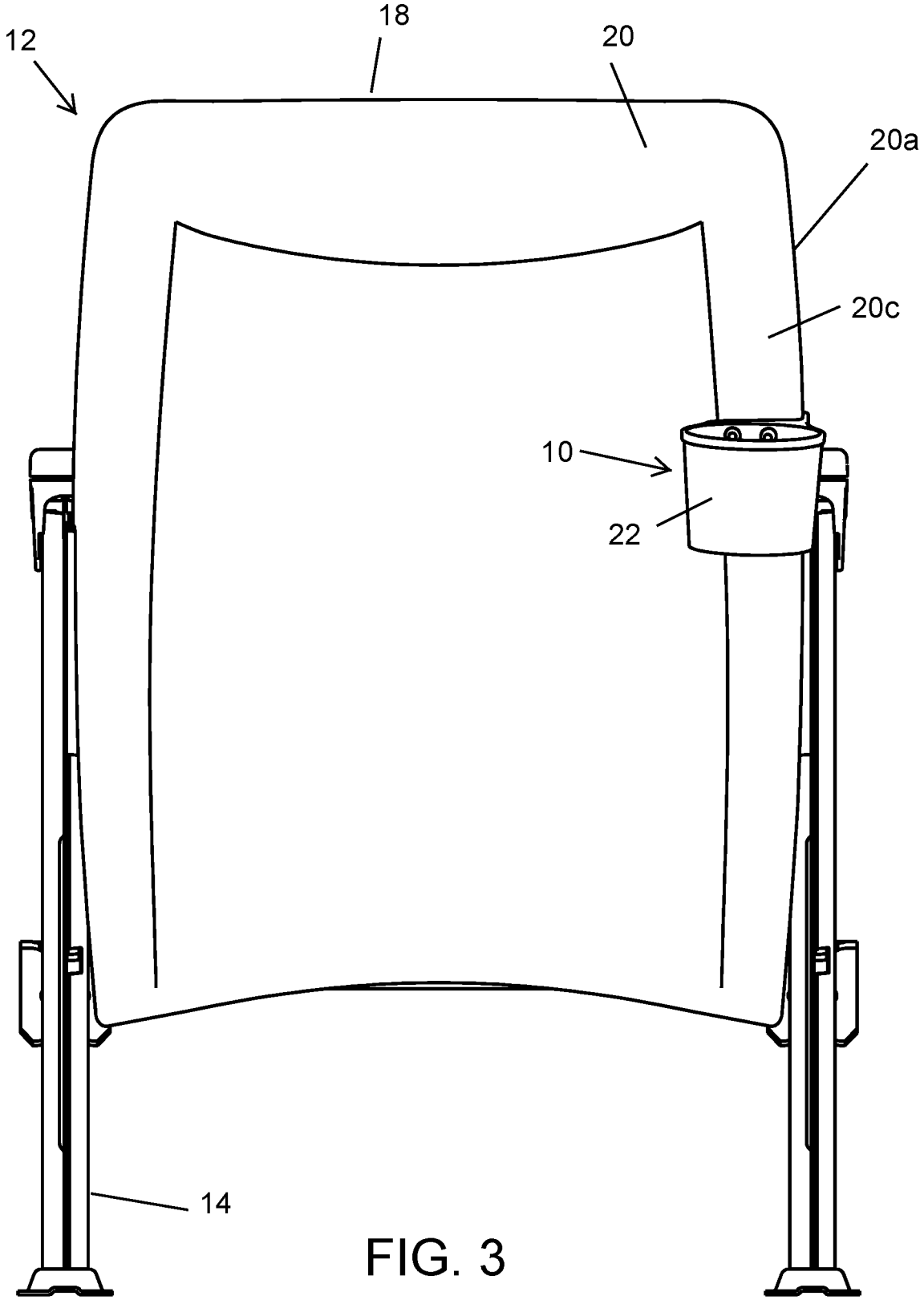
FIG. 3 is a rear elevation of the seat and cup holder.
Figure 4:
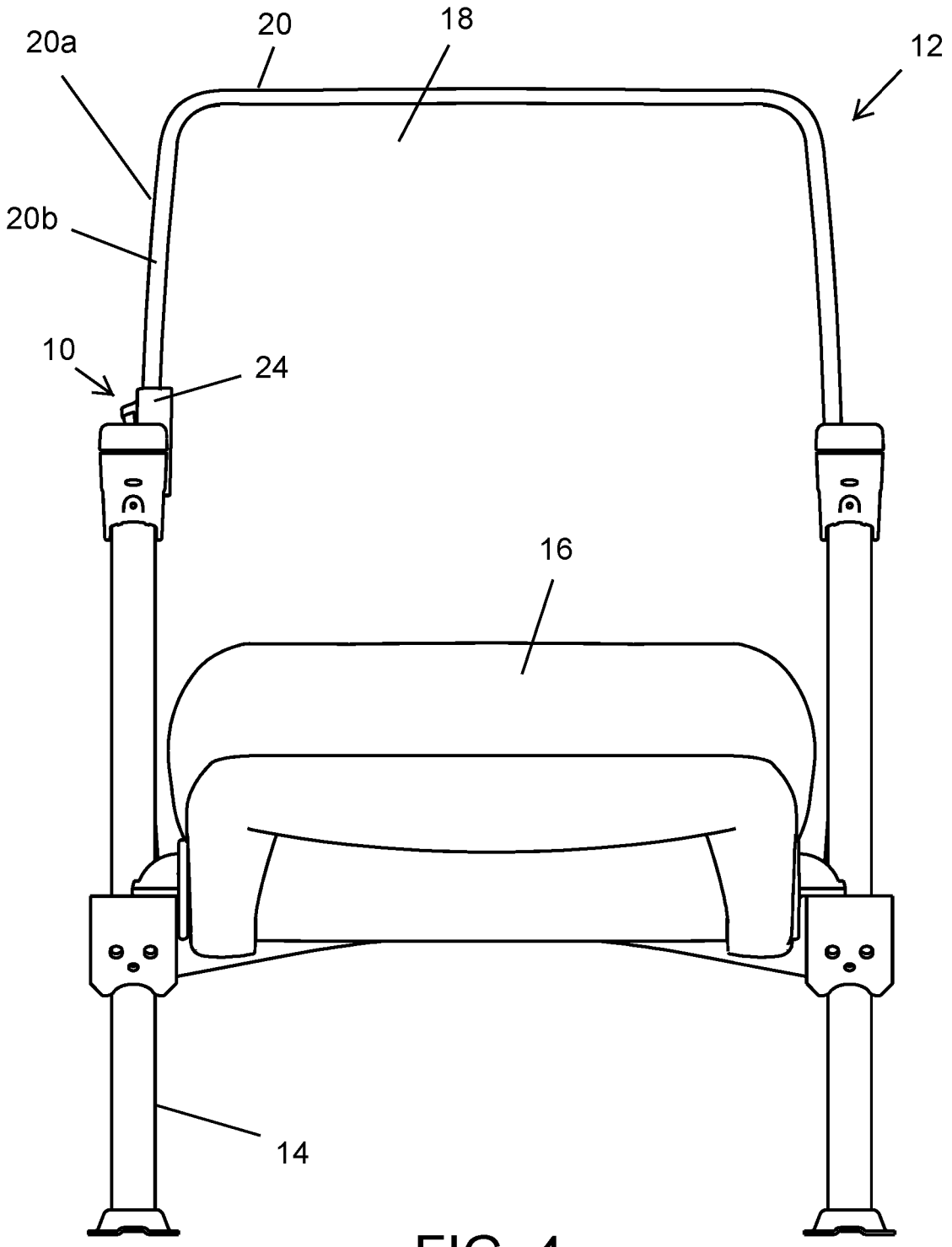
FIG. 4 is a front elevation of the seat and cup holder.
Figure 5:
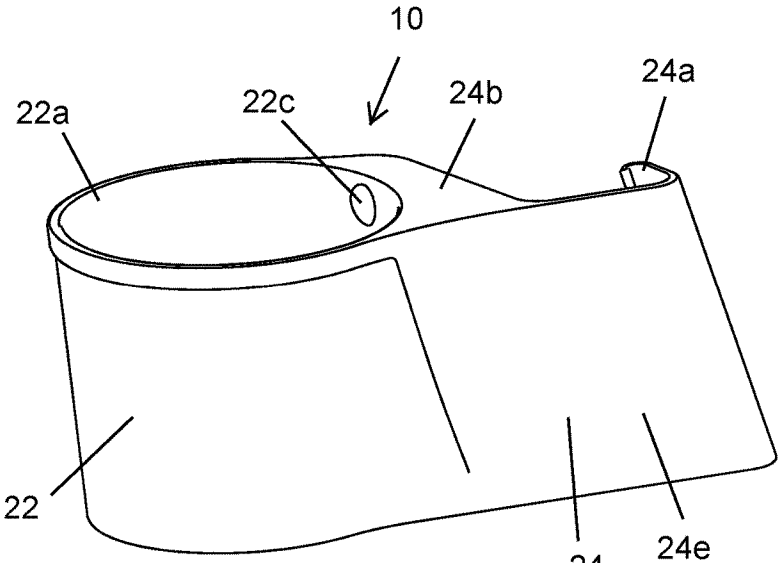
FIG. 5 is a perspective view of the cup holder.
Figure 8:
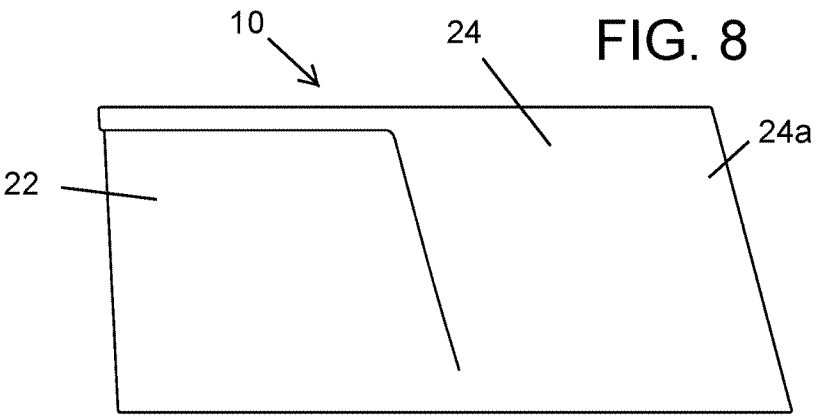
FIG. 8 is a side view of the cup holder of FIG. 5.

Referring now to the drawings and the illustrative embodiments depicted therein, a cup holder 10 is configured to mount at an individual seat or chair 12 of a stadium or theater or auditorium seating configuration (FIGS. 1-4). Such a seating configuration comprises a plurality of chairs arranged in rows. The individual chairs of the seating configuration are arranged one next to another, with an arm rest disposed between the adjacent chairs. The seating configuration may utilize aspects of the seating configurations described in U.S. Pat. Nos. 8,256,835 and/or 6,652,030, which are hereby incorporated herein by reference in their entireties.

The seats or chairs 12 each comprise a base or frame structure 14 that typically comprises a pair of generally vertical stanchions to which a seat or base 16 is pivotally mounted and pivotable between a use position, where the seat is folded down for a person to sit on (as shown in FIGS. 1-4), and a stowed position, where the seat base is folded up so people can walk along and between the rows of seats or chairs. The seats also include a seat back 18 that is mounted at the frame structure (and may pivot relative to the frame structure to allow for reclining of the seat back). The seat back 18 includes a plastic frame 20 with vertical sides 20*a* that have a front portion 20*b* at the front side of the seat (see FIG. 4) and a rear portion 20*c* at the rear side of the seat (see FIG. 3). The cup holder 10 is configured to mount at the vertical side of an individual chair.

The cup holder 10 includes a cup receiving body 22 that has a generally cylindrical cup receiver 22*a* and a bottom 22*b* for receiving and supporting a cup therein. The cup holder also has a mounting arm 24 that extends rearward from the receiving body 22 and that has a receiving portion 24*a* that is configured to receive or hook around the front part or portion 20*b* of the plastic frame 20 of the seat back 18 of the chair 12. A fastening portion 24*b* of the mounting arm 24 is configured to attach at the rear surface or portion 20*c* of the plastic frame 20 of the seat back 18 of the chair 12 for fastening or securing the cup holder at the desired height along the seat back frame via one or more fasteners.

In the illustrated embodiment of FIGS. 5-8, the fastening portion 24*b* of the mounting arm 24 comprises two holes or apertures 24*c* for receiving respective fasteners therethrough. The holes 24*c* are established through a rear abutment surface 24*d* of the fastening portion 24*b* and are aligned with holes 22*c* at the generally cylindrical receiver 22*a* of the cup receiving body 22. The holes 22*c* of the cup receiver 22*a* are larger diameter than the holes 24*c* of the fastening portion 24*b* so that the head of the fasteners (such as threaded fasteners such as screws or the like) are received through the holes 24*c* and are not visible at the inner surface of the cup receiver 22*a*. Optionally, a cap or cover may be provided at the holes 24*c* to cover the holes (after the cup holder is mounted at the chair) to conceal the fasteners and to provide a generally uniform inner surface of the cup receiver 22*a*.

As shown in FIGS. 5-8, the receiving portion 24*a* of the mounting arm comprises a hook-shaped or J-shaped element that is configured to hook around the front portion 20*b* of the plastic frame of the seat back. The end of the J-shaped receiving element or portion wraps around the inner side of the front portion of the plastic frame so that the plastic frame is received in the receiving portion. The receiving portion may be flexible to allow for limited flexing during attachment of the cup holder at the plastic seat frame. When the front portion of the plastic frame is received in the receiving portion 24*a*, the abutment surface 24*d* of the fastening portion 24*b* abuts against the rear surface or portion 20*c* of the plastic frame 20, and a side wall 24*e* (that connects between the receiving portion and the fastening portion) of the mounting arm 24 spans the width or depth of the side portion 20*a* of the plastic seat frame (and may be configured or shaped to conform with or correspond with the shape of the particular seat back frame to which the cup holder is being mounted). The angle of the receiving portion 24*a* is selected to correspond with the angle of the front part of the seat back frame and the angle and/or contour of the abutment surface 24*d* is selected to correspond with the angle and/or contour of the rear part of the seat back frame. Typically, the angles of the front part of the seat back frame and of the rear part of the seat back frame will be similar or the same (such that the abutment surface is generally parallel to an inside surface of the receiving portion that abuts the front surface of the front portion of the seat back frame) depending on the shape of the side portion of the seat back frame.

Figure 6:
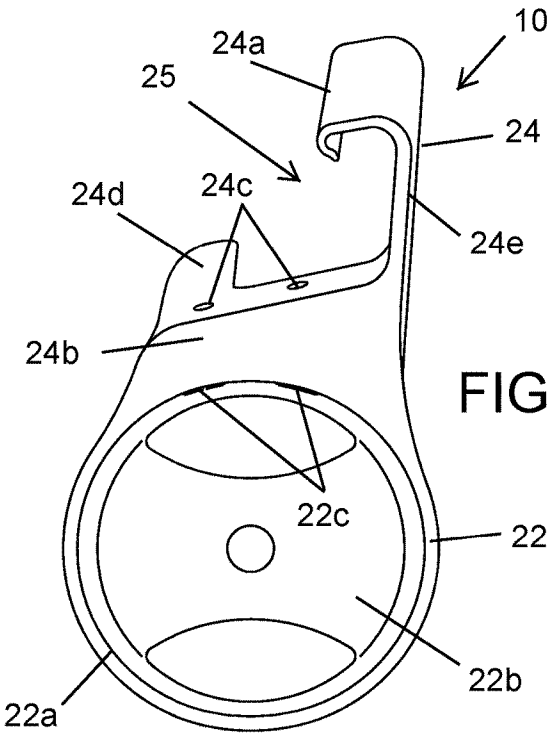
FIG. 6 is a top view of the cup holder of FIG. 5.
Figure 7:
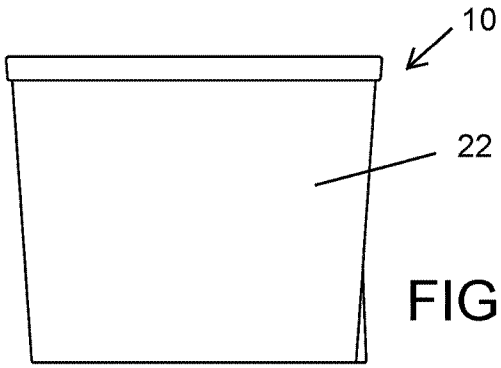
FIG. 7 is an end view of the cup holder of FIG. 5.
Figure 9:
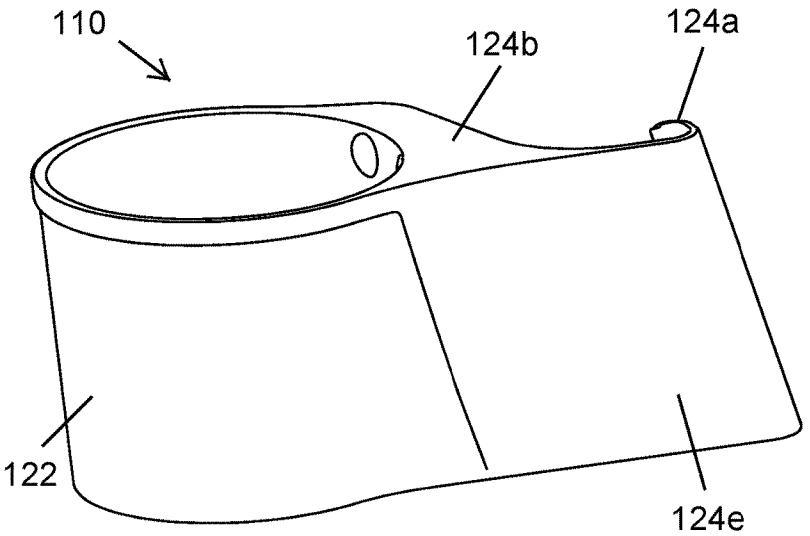
FIG. 9 is a perspective view of another cup holder with a different shaped receiving portion for mounting at another seat back.
Figure 12:
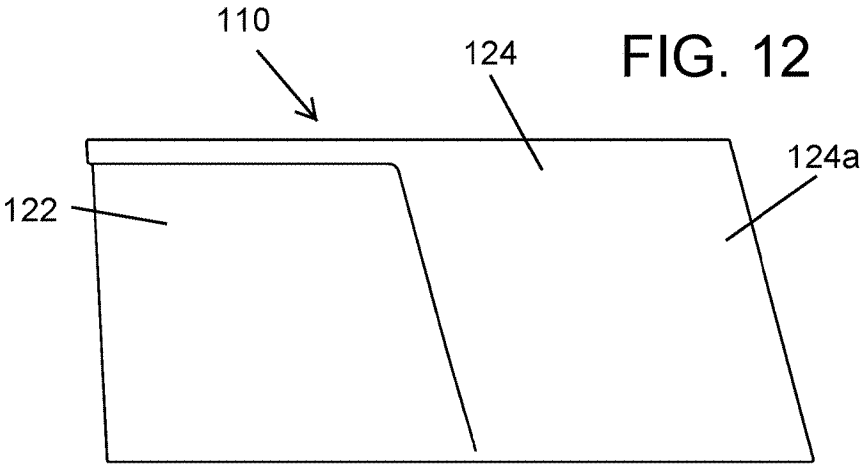
FIG. 12 is a side view of the cup holder of FIG. 9.
Figure 10:
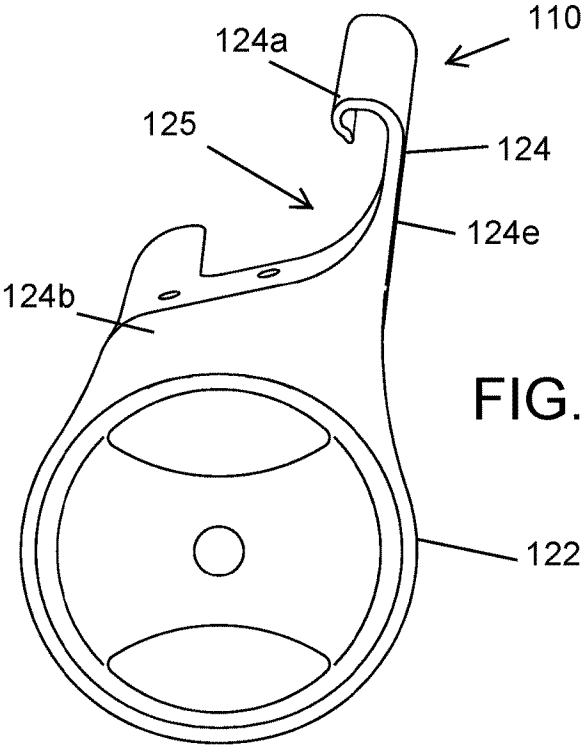
FIG. 10 is a top view of the cup holder of FIG. 9.
Figure 11:
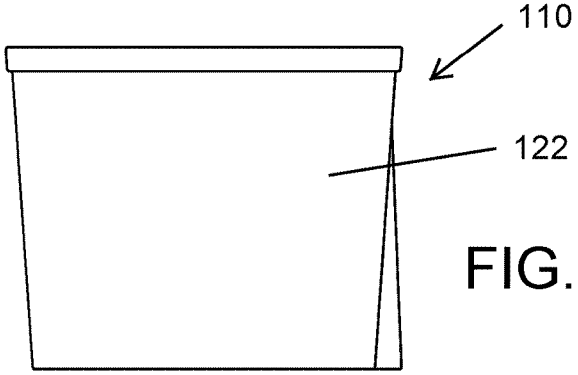
FIG. 11 is an end view of the cup holder of FIG. 9.

As shown in FIG. 1, the mounting arm 24 may initially be positioned at an upper end region of the plastic frame 20 (since it may be easier to slide the cup holder onto the side part of the plastic frame from the top of the plastic frame), whereby the cup holder may be slid downward to the desired location along the seat back frame. The receiving portion 24*a* of the mounting arm thus receives the side portion of the plastic frame therein and allows for movement of the cup holder along the plastic frame while the receiving portion and fastening portion limit or preclude movement of the cup holder and mounting arm forward or rearward or sideward relative to the seat back frame. When attaching the cup holder at the seat back frame, the receiving portion 24*a* and the side wall 24*e* of the mounting arm may flex to receive the side portion of the seat back frame within the generally C-shaped receptacle 25 defined by the receiving portion, the side wall and the mounting portion (and as best shown in FIG. 6).

When the cup holder is positioned at the desired height or location along the seat back frame (see FIG. 2), the fasteners are located at and through the holes 22*c* and 24*c* and driven into the seat back frame to attach or secure or affix the attachment portion of the cup holder to the rear portion of the seat back frame to secure the cup holder at that location. The seat back frame may have holes already started or formed at the appropriate or desired locations, or the fasteners may be driven through the material of the back portion of the plastic frame. Although shown as having two fasteners, the cup holder may be retained in place at the seat back frame via only one fastener (such as a threaded fastener or other fastener means that may penetrate or secure at the seat back frame) or via more than two fasteners. Optionally, the seat back frame and the cup holder may comprise corresponding locking elements (such as an aperture at one and a flexible locking tab at another) that allow for snap attachment of the cup holder when it is moved to the proper location along the seat back frame. Optionally, the mounting arm may provide for snap attachment of the cup holder at the seat back frame, and may resist movement of the cup holder along the seat back frame, and/or the seat back frame may have a protrusion or lip that is configured to engage a lower end of the mounting arm to limit downward movement of the mounting arm along the seat back frame when the cup holder is at the desired or selected location, such that the cup holder may be attached at and retained at the seat back frame without fasteners.

The shape of the mounting arm, and particularly of the receiving portion of the mounting arm may be selected or designed for different shaped seat back frames. For example, and such as shown in FIGS. 9-12, a cup holder 110 includes a more curved receiving portion 124*a* and a more curved side wall 124*e* of its mounting arm 124 to define a shallower C-shaped receptacle 125 to accommodate and receive a narrower and rounder side portion of the seat back frame of the chair at which the cup holder is to be mounted. The cup holder 110 is otherwise similar to the cup holder 10, discussed above, such that a detailed discussion of the cup holders need not be repeated herein. Briefly, the cup holder 110 includes a cup receiving body 122 for receiving and supporting a cup therein, with the mounting arm 124 extending rearward from the receiving body 122. The receiving portion 124*a* is configured to receive or hook around the front part or portion of the seat back frame of the chair and the fastening portion 124*b* is configured to attach at the rear surface or portion of the seat back frame of the chair for fastening or securing the cup holder at the desired height along the seat back frame via one or more fasteners, with the side wall 124*e* spanning between the receiving portion 124*a* and the fastening portion 124*b* and configured to engage and abut the side surface of the seat back frame, such as in a similar manner as described above.

Therefore, the cup holder of the present invention provides an attachment configuration that attaches to a seat back frame of a single chair, and thus avoids issues that may arise when the gap size is different between two adjacent chairs. The cup holder is readily positioned at the single seat back frame and secured at the desired or appropriate or selected position. The cup holder may snap or otherwise attach at the seat back frame so that the receiving portion receives the forward portion of the frame and the abutment surface abuts the rear portion or surface of the frame to partially or generally clamp the side of the seat back frame at the mounting arm (but not so tightly that the cup holder cannot be moved vertically along the seat back frame). The position of the cup holder may be easily adjusted along the seat back frame by sliding the cup holder along the seat back frame, whereby, when in the targeted location, the cup holder is secured to the seat back frame via one or more fasteners or via snap attachment or the like.

Changes and modifications in the specifically described embodiments can be carried out without departing from the principles of the invention, which is intended to be limited only by the scope of the appended claims, as interpreted according to the principles of patent law including the doctrine of equivalents.

The invention claimed is:

1. A seat for an auditorium or theater of stadium, the seat comprising:

a seat back and seat portion, the seat back disposed at a seat back frame;

a cup holder comprising a cup receiving body and a mounting arm;

wherein the cup receiving body is configured to receive and support a cup therein when the cup holder is mounted at the seat;

wherein the mounting arm extends from the cup receiving body and comprises a receiving portion and an attachment portion;

wherein the mounting arm is configured to extend across a side portion of the seat back frame, and wherein the receiving portion is configured to receive a front portion of the seat back frame;

wherein, with the receiving portion receiving the front portion of the seat back frame and the mounting arm extending from the front portion of the seat back frame to a rear portion of the seat back frame, the attachment portion of the mounting arm abuts the rear portion of the seat back frame; and wherein, with the receiving portion receiving the front portion of the seat back frame and the mounting arm extending from the front portion of the seat back frame to the rear portion of the seat back frame and the attachment portion of the mounting arm abutting the rear portion of the seat back frame, the attachment portion is attached at the seat back frame to secure the cup holder relative to the seat back frame.

2. The seat of claim 1, wherein, with the receiving portion receiving the front portion of the seat back frame and the mounting arm extending from the front portion of the seat back frame to the rear portion of the seat back frame and the attachment portion of the mounting arm abutting the rear portion of the seat back frame, the cup holder is movable along the seat back frame to position the cup holder at a selected location or height at the seat back frame.

3. The seat of claim 1, wherein the attachment portion is attached at the seat back frame via one or more fasteners.

4. The seat of claim 1, wherein the attachment portion is attached at the seat back frame via one or more threaded fasteners.

5. The seat of claim 1, wherein the attachment portion is attached at the seat back frame via engagement with an attaching element of the seat back frame.

6. The seat of claim 1, wherein the receiving portion of the mounting arm comprises a J-shaped element that is configured to at least partially wrap around the front portion of the seat back frame to limit lateral movement of the mounting arm relative to the front portion of the seat back frame.

7. The seat of claim 1, wherein the mounting arm provides a C-shaped receptacle for receiving at least a portion of the side portion of the seat back frame therein.

8. The seat of claim 1, wherein the seat is an individual seat of a row of seats, and wherein, with the receiving portion receiving the front portion of the seat back frame and the mounting arm extending from the front portion of the seat back frame to the rear portion of the seat back frame and the attachment portion of the mounting arm abutting the rear portion of the seat back frame and with the attachment portion attached at the seat back frame, the cup holder is attached to the seat back frame of the individual seat of the row of seats and does not contact a seat back frame of another seat adjacent to the individual seat along the row of seats.

9. A method of mounting a cup holder to a seat back frame of an individual seat of an auditorium or theater, the method comprising:

providing a cup holder comprising a cup receiving body and a mounting arm, wherein the cup receiving body is configured to receive and support a cup therein when the cup holder is mounted at a seat, and wherein the mounting arm extends from the cup receiving body and comprises a receiving portion and an attachment portion;

positioning the cup holder at a side of a seat back frame of a single seat of a row of seats of an auditorium or theater or stadium so that the receiving portion receives a front portion of the seat back frame and the mounting arm extends rearward across a side portion of the seat back frame;

with the receiving portion receiving the front portion of the seat back frame and the mounting arm extending from the front portion of the seat back frame to a rear portion of the seat back frame, abutting the attachment portion of the mounting arm with the rear portion of the seat back frame; and with the receiving portion receiving the front portion of the seat back frame and the mounting arm extending from the front portion of the seat back frame to the rear portion of the seat back frame and the attachment portion of the mounting arm abutting the rear portion of the seat back frame, attaching the attachment portion at the seat back frame to secure the cup holder relative to the seat back frame.

10. The method of claim 9, comprising, with the receiving portion receiving the front portion of the seat back frame and the mounting arm extending from the front portion of the seat back frame to the rear portion of the seat back frame and the attachment portion of the mounting arm abutting the rear portion of the seat back frame, moving the cup holder along the seat back frame to position the cup holder at a selected location or height at the seat back frame.

11. The method of claim 9, wherein attaching the attachment portion at the seat back frame comprises fastening the attachment portion to the seat back frame using at least one fastener.

12. The method of claim 9, wherein attaching the attachment portion at the seat back frame comprises fastening the attachment portion to the seat back frame using at least one threaded fastener.

13. The method of claim 9, wherein attaching the attachment portion at the seat back frame comprises engaging the attachment portion with an attaching element of the seat back frame.

14. The method of claim 9, wherein the receiving portion of the mounting arm comprises a J-shaped element, and wherein the method comprises at least partially wrapping the J-shaped element around the front portion of the seat back frame to limit lateral movement of the mounting arm relative to the front portion of the seat back frame.

15. The method of claim 9, wherein, after attaching the attachment portion at the seat back frame to secure the cup holder relative to the seat back frame, the cup holder is attached at a single seat back frame of a single individual seat and does not contact a seat back frame of another seat adjacent to the single individual seat.

16. A seating system for an auditorium or theater of stadium, the seating system comprising:

a plurality of seats arranged in a plurality of rows of seats;

wherein the plurality of seats comprises an individual seat of a row of seats, the individual seat comprising a seat back and seat portion, the seat back disposed at a seat back frame;

a cup holder comprising a cup receiving body and a mounting arm;

wherein the cup receiving body is configured to receive and support a cup therein when the cup holder is mounted at the individual seat;

wherein the mounting arm extends from the cup receiving body and comprises a receiving portion and an attachment portion;

wherein the mounting arm is configured to extend across a side portion of the seat back frame of the individual seat, and wherein the receiving portion is configured to receive a front portion of the seat back frame;

wherein the receiving portion of the mounting arm comprises a J-shaped element that is configured to at least partially wrap around the front portion of the seat back frame to limit lateral movement of the mounting arm relative to the seat back frame;

wherein, with the receiving portion receiving the front portion of the seat back frame and the mounting arm extending from the front portion of the seat back frame to a rear portion of the seat back frame, the attachment portion of the mounting arm abuts the rear portion of the seat back frame;

wherein, with the receiving portion receiving the front portion of the seat back frame and the mounting arm extending from the front portion of the seat back frame to the rear portion of the seat back frame and the attachment portion of the mounting arm abutting the rear portion of the seat back frame, the cup holder is movable along the seat back frame to position the cup holder at a selected location at the seat back frame;

wherein, with the receiving portion receiving the front portion of the seat back frame and the mounting arm extending from the front portion of the seat back frame to the rear portion of the seat back frame and the attachment portion of the mounting arm abutting the rear portion of the seat back frame, the attachment portion is attached at the rear portion of the seat back frame to secure the cup holder relative to the seat back frame at the selected location at the seat back frame; and wherein, with the receiving portion receiving the front portion of the seat back frame and the mounting arm extending from the front portion of the seat back frame to the rear portion of the seat back frame and the attachment portion of the mounting arm abutting the rear portion of the seat back frame and with the attachment portion attached at the rear portion of the seat back frame, the cup holder is attached to the seat back frame of the individual seat of the row of seats and does not contact another seat back frame of another seat adjacent to the individual seat along the row of seats.

17. The seating system of claim 16, wherein the attachment portion is attached at the rear portion of the seat back frame of the individual seat via one or more fasteners.

18. The seating system of claim 16, wherein the attachment portion is attached at the rear portion of the seat back frame of the individual seat via one or more threaded fasteners.

19. The seating system of claim 16, wherein the attachment portion is attached at the rear portion of the seat back frame of the individual seat via engagement with an attaching element of the seat back frame of the individual seat.

20. The seating system of claim 16, wherein the receiving portion and the attachment portion of the mounting arm provide a C-shaped receptacle for receiving at least a portion of the side portion of the seat back frame of the individual seat therein.

* * * * *